US006325456B1

(12) United States Patent
Carnahan

(10) Patent No.: US 6,325,456 B1
(45) Date of Patent: Dec. 4, 2001

(54) CHAIR WITH A SLIDING AND SWIVELING DEVICE

(76) Inventor: Garnett Carnahan, 337 E. Lindbergh, Nixa, MO (US) 65714

( * ) Notice: Subject to any disclaimer, the term of this patent is extended or adjusted under 35 U.S.C. 154(b) by 0 days.

(21) Appl. No.: 09/651,372

(22) Filed: Aug. 30, 2000

Related U.S. Application Data

(63) Continuation-in-part of application No. 09/506,904, filed on Feb. 18, 2000.

(51) Int. Cl.[7] ..... A47C 3/18
(52) U.S. Cl. ..... 297/344.24; 297/463.1
(58) Field of Search ..... 297/344.1, 344.24, 297/344.22, 344.26, 463.1; 248/131, 416

(56) References Cited

U.S. PATENT DOCUMENTS 4,168,050 * 9/1979 Nerem et al. ..... 297/344.22 X
5,702,084 * 12/1997 Carnahan et al. ..... 248/416
5,704,729 1/1998 Carnahan et al. ..... 297/344.24 X
5,884,887 * 3/1999 Garelick et al. ..... 248/416 X

* cited by examiner

*Primary Examiner*—Peter R. Brown
(74) *Attorney, Agent, or Firm*—Rabin & Champagne, P.C.

(57) ABSTRACT

A chair having sliding and swiveling device, mounted on a stationary post for adjustment. A slide plate supports the chair and a lower surface has a longitudinally extending roller channel, in which a plurality of rollers of a holder are provided to support the slide plate so that the slide plate is longitudinally slideable. The holder swivels on the post. A first lock releasably locks the holder against swiveling; and a second lock releasably locks the slide plate against sliding. A lock controller, including a handle, controls both locks, wherein rotating of the handle in a one direction locks the holder against swiveling, and rotating in an opposite direction locks the slide plate against sliding. The handle extends and retracts toward and away from the post. When the chair has a horizontal seat with a front portion that is pivotable upward if the chair is unused, the slide plate supports a rear portion of the seat on the upper surface of a support portion of the plate, and the lower surface has two roller channels to receive the rollers of the holder. The lock controller includes an elongated control member for coupling the handle to the locks, so that by rotating the handle the control member is rotated to control the locks. The control member is extendible to bring the handle from beneath the rear seat portion to a forward end of the seat, for convenient access.

14 Claims, 6 Drawing Sheets

CHAIR WITH A SLIDING AND SWIVELING DEVICE

CROSS-REFERENCE TO RELATED APPLICATION

The subject matter of the present invention is a continuation-in-part of applicants' copending application Ser. No. 09/506,904, field Feb. 18, 2000, the disclosure of which is incorporated by reference.

BACKGROUND OF THE INVENTION

1. Field of the Invention

This invention relates in general to an adjustable mounting device for use with a post mounted item such as a chair. More specifically, the invention enables the operator to swivel the item 360-degrees in a rotational direction and to slide it backward and forward on rollers in a horizontal direction, by adjusting a single telescoping handle that may be retracted when it is not in use.

2. Description of the Related Art

Because of the high speeds and heavy shaking involved with vehicles such as pleasure boats, chairs for these vehicles are typically mounted on a support post fixed to the underlying deck. To permit the occupant to adjust the rotational and longitudinal position of the chair, a sliding and swiveling device is mounted between the chair and the stationary post. The cam locking type sliding and swiveling device, as described in U.S. Pat. No. 5,704,729, the disclosure of which is incorporated herein by reference, includes a slide plate and a holder. The holder has a lower cylindrical sleeve portion and an upper web portion. The sleeve is shaped to receive the post and it is rotatably coupled to the post in a manner that allows the holder to swivel 360-degrees in a rotational direction around the post. The top of the upper web portion terminates in a pair of parallel longitudinal skids. The slide plate has an upper surface and a lower surface. The upper surface supports an item such as a chair. The lower surface of the slide plate has a pair of parallel longitudinal tracks which receive the skids of the holder, and in this manner the slide plate is slidably coupled to the holder permitting the slide plate to slide longitudinally with respect to the holder. The device also features a first locking assembly for releasably locking the slide plate and holder against rotation with respect to the chair post. A second locking assembly is provided for releasably locking the slide plate and holder against longitudinal sliding. The device features a handle and an assembly for triggering a release of the first locking assembly upon rotation of the handle in a first direction (e.g., clockwise) and for triggering a release of the second locking assembly upon rotation of the same handle in a second direction (e.g., counter-clockwise). Biasing devices are provided to place the two locks or locking assemblies in a locking state when the handle is not rotated in one direction or the other.

The slide plate slides on a pair of parallel tracks. An item such as a chair is attached to the upper surface of the slide plate. When the overlying chair is stationary, static friction forces develop between the track and the skid. Thus, to move the chair forward or backward, the operator must shove the chair with enough force to overcome the static friction forces, and this can cause the chair to slide past or overshoot the desired position. To slide the chair back from the over-shot location to the desired position, sufficient force must be developed once again, and this may cause the chair again to slide past the desired location.

When an item such as a chair is mounted to a boat deck utilizing a conventional sliding and swiveling device, the chair obstructs precious deck space, whether or not it is in use. In addition, the handle must protrude laterally outward from the device to an outer edge of the chair so that the operator can reach it with ease. Thus, the handle of the sliding and swiveling device as well obstructs the boat deck space.

It can be understood from the above discussion that the prior sliding and swiveling device offers serviceable performance. However, longitudinal adjustment of the prior arrangement is inaccurate and inconvenient, because the operator must shove the chair hard enough to develop a large momentum to overcome static friction forces, and as a result the desired new location may be over-shot. Furthermore, the device and the item that the device supports obstruct space, whether or not they are in use. Finally, the rotational locking mechanism, or thrust plate, is composed from numerous components, and as a result it is relatively complicated to manufacture.

It is therefore an object of the invention to provide a sliding and swiveling device that develops a minimal amount of static friction when it is at rest, requires less force for horizontal movement, and does not obstruct lateral space when the device is not in use. A still further object is to provide such a device that utilizes a rotational locking mechanism having a minimal number of components.

SUMMARY OF THE INVENTION

The invention provides a sliding and swiveling device, for adjustment of an item, such as a chair, mounted on a stationary post. It includes a slide plate having a support portion for supporting the item on an its upper surface, a lower surface of the support portion having a longitudinally extending roller channel. A holder, which is adapted to be mounted to swivel on a stationary post, has a plurality of rollers longitudinally spaced apart in the channel, to support the slide plate so that the slide plate is longitudinally slideable. A first lock releasably locks the holder against swiveling with respect to the post; and a second lock releasably locking the slide plate against longitudinal sliding with respect to the holder. A lock controller, including a handle, controls both locks, wherein rotating of the handle in a one direction from a neutral position, locks the holder against swiveling, and rotating of the handle from the neutral position in an opposite direction locks the slide plate against longitudinal sliding. The handle is extendible and retractable respectively toward and away from the post.

In a preferred embodiment, two opposing lateral sides of the slide plate form two C-shaped channels, and a plurality of rollers are confined within each channel.

According to another aspect of the invention, the supported item is a chair and forms, with the device, a chair system. The chair has a horizontal seat with a rear portion and a front portion, with the front portion being pivotable upward so as to occupy less deck space when the chair is not in use. The slide plate supports the rear portion of the chair seat on the upper surface of the plate's support portion, and the lower surface of the support portion has two longitudinally extending roller channels. The rollers of the holder are longitudinally spaced apart in both channels, so that the slide plate is longitudinally slideable with respect to said holder, on the rollers. The lock controller includes an elongated control member for use in coupling the handle at one end, to the two locks, so that by rotating the handle, and thus the control member, the control member is rotated to control the locks. The control member is extendible to bring the handle to a forward end of the forward seat portion, for convenient access by an occupant of the chair, and is retractable to bring the handle beneath the rear seat portion. Thus, when the chair is unoccupied, deck space is conserved by pivoting the front seat portion upward and retracting the control member. Moreover, according to another aspect of the invention, the coupling between the handle and the locks through the control member is the same in the when the control member is extended as when it is retracted, so that the controller operable to control the locks in both states.

The foregoing object to provide a device which develops a minimal amount of friction is accomplished by the above described device in that it provides rollers within the holder and the slide plate to reduce friction between the holder and the slide plate. In addition, the rotational locking mechanism has only two components, a thrust plate and a biasing device, thus it utilizes a minimum amount of parts. The foregoing object to provide a device having a handle that does not obstruct use of lateral space when the device is not in use, is achieved by the telescoping handle.

BRIEF DESCRIPTION OF THE DRAWINGS

Other objects, features, and advantages of the invention will become apparent by way of the following detailed description of the preferred but non-limiting embodiments. The description is made with reference to the accompanying drawings in which.

DETAILED DESCRIPTION OF THE PREFERRED EMBODIMENTS

Figure 1:
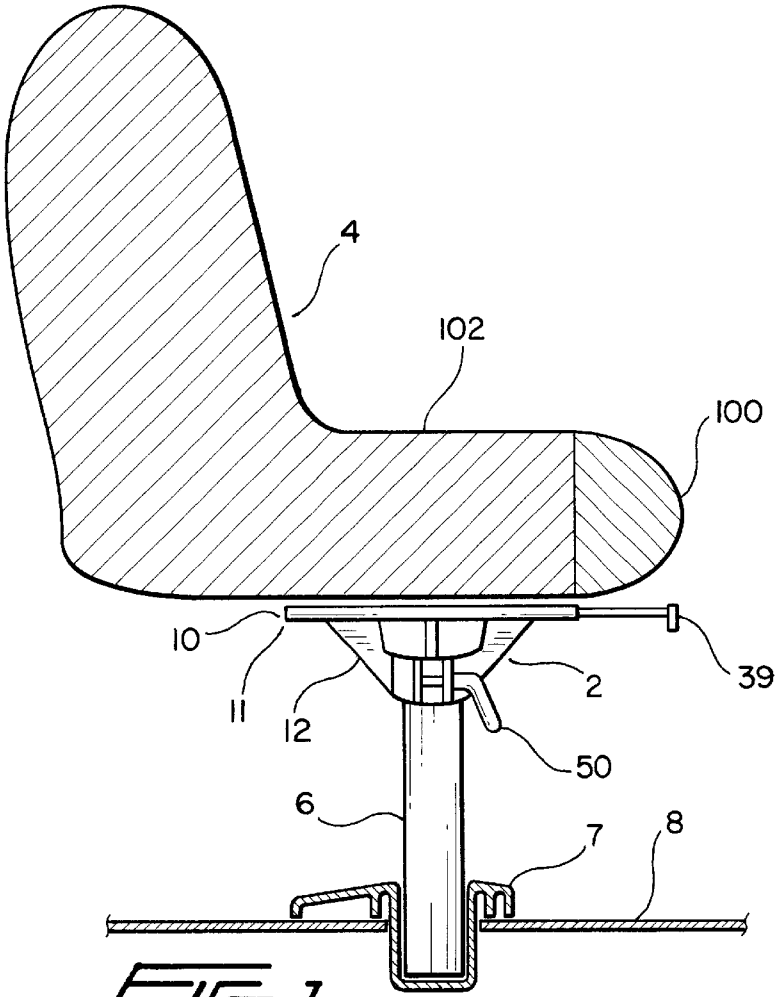
FIG. 1 is a side view of a sliding and swiveling device attached to a post mounted chair in accordance with the invention, with the chair shown in schematic side cross section, and showing the telescoping handle fully extended.

FIG. 1 is a side cross-sectional view of a sliding and swiveling device 2, in accordance with the invention, attached to an item 4 in the form of a post mounted chair, wherein the chair 4 is shown in schematic side cross section. The chair 4 is a conventional chair adapted for use on boats, having a rear seat portion 102 and a front seat portion in the form of a thigh rest 100, wherein the thigh rest 100 is hingedly connected to the rear seat portion, and is shown in its extended position for support of an occupant's thighs during use. The particular manner of hinged connection is not important to the invention, and so such hinges are omitted from the drawings for the sake of simplicity.

The chair 4 is rotatably and slidably attached to a stationary post 6 via the sliding and swiveling device 2. The post 6 preferably is mounted within a base assembly 7, which is fixed to a surface 8 such as that of a deck of a boat.

Figure 2:
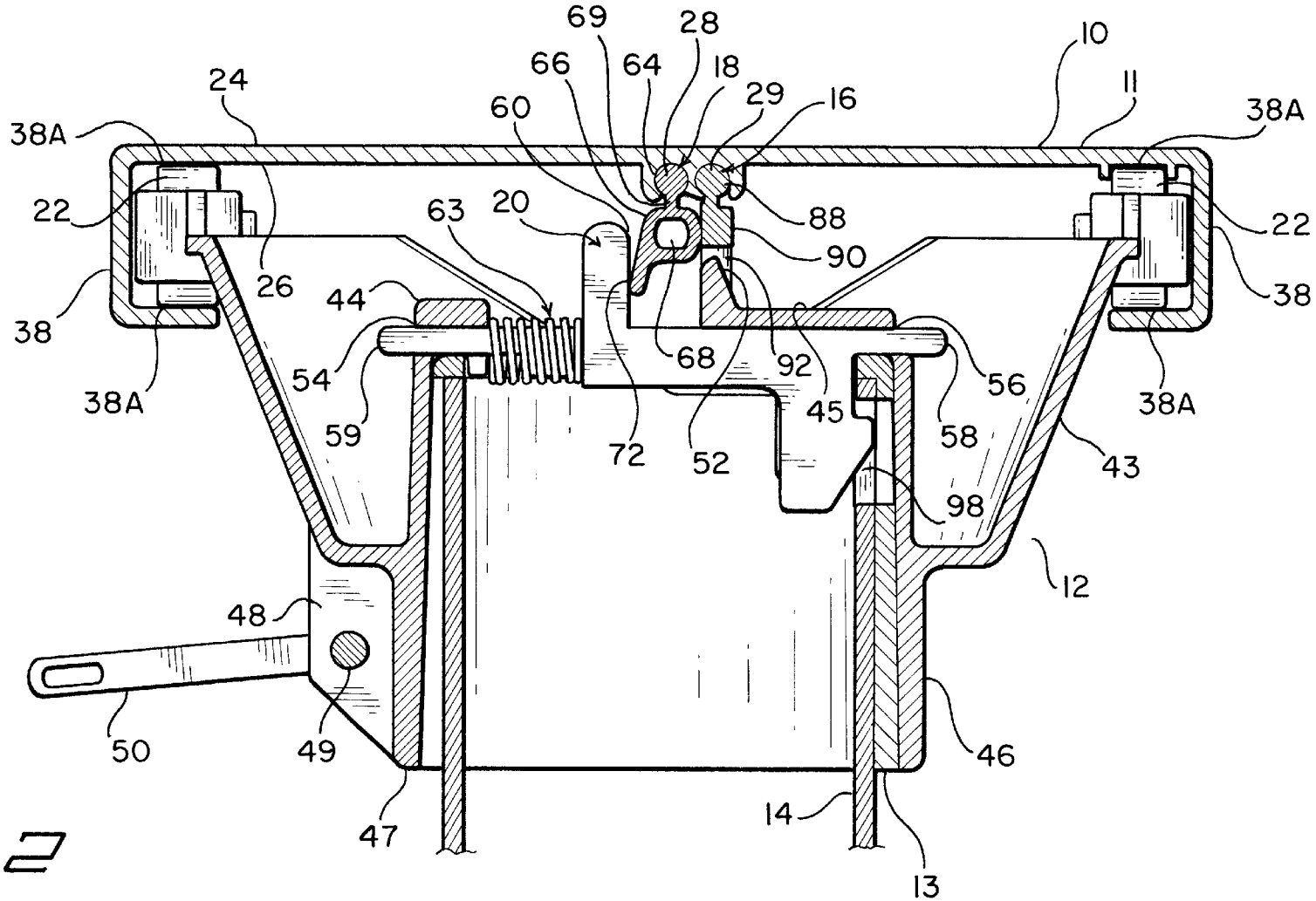
FIG. 2 is a cross section of the device showing the cam plate and the push plate.

Referring to the cross-sectional view of FIG. 2, the sliding and swiveling device 2 includes a slide plate 10, a slide plate holder 12, a spacer sleeve 13, a stationary post 14, a push plate 16, a cam plate 18, a thrust plate 20, and rollers 22. The slide plate 10 has a flat, preferably rectangularly shaped support portion 11 having an upper surface 24 and a lower surface 26, that serves as a base for the item 4.

Figure 3:
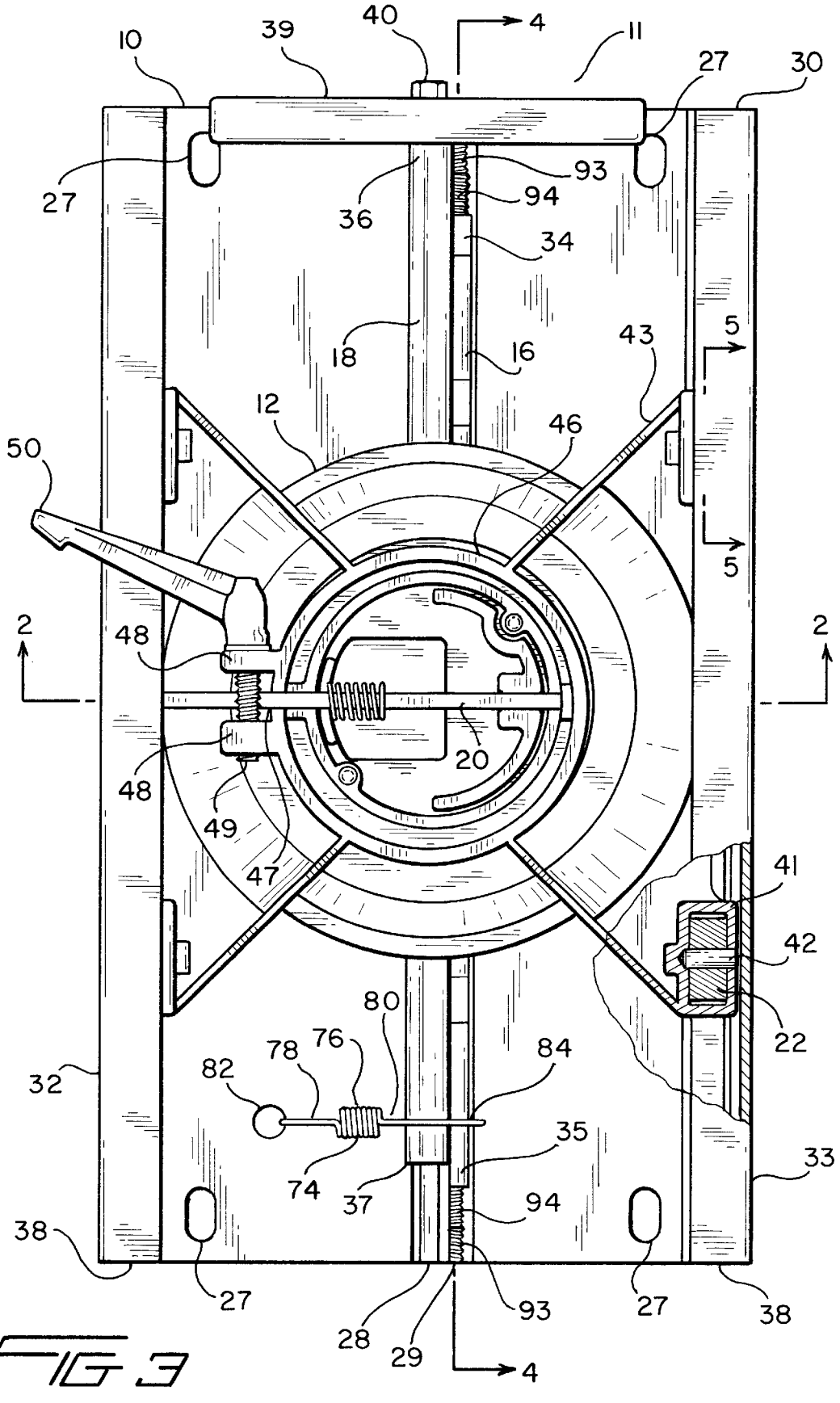
FIG. 3 is plan view of the underside of the device.

FIG. 3 is plan view of the underside of the slide plate 10. Mounting holes 27 preferably are provided in the slide plate 10 for fastening the item 4 to its upper surface 24. As shown in FIG. 2, a "C" shaped longitudinal first reception slot 28 a and a second reception slot 29 are integrally formed to protrude from the lower surface 26 of the slide plate 10. The slide plate 10 also has two parallel sides 32, 33. Similarly, the push plate 16 has a first end 34 and a second end 35, and the cam plate 18 has a second end 37. The parallel sides 32, 33 of the slide plate 10 are formed into C-shaped roller channels 38 that confine the rollers 22 (see FIG. 5). As best shown in FIGS. 3 and 6, a handle 39, which is telescoping as explained below, is fastened to a first end 36 of the cam plate 18 with a bolt or other suitable fastener 40, and is located at a first end 30 of the slide plate 10.

Figure 4:
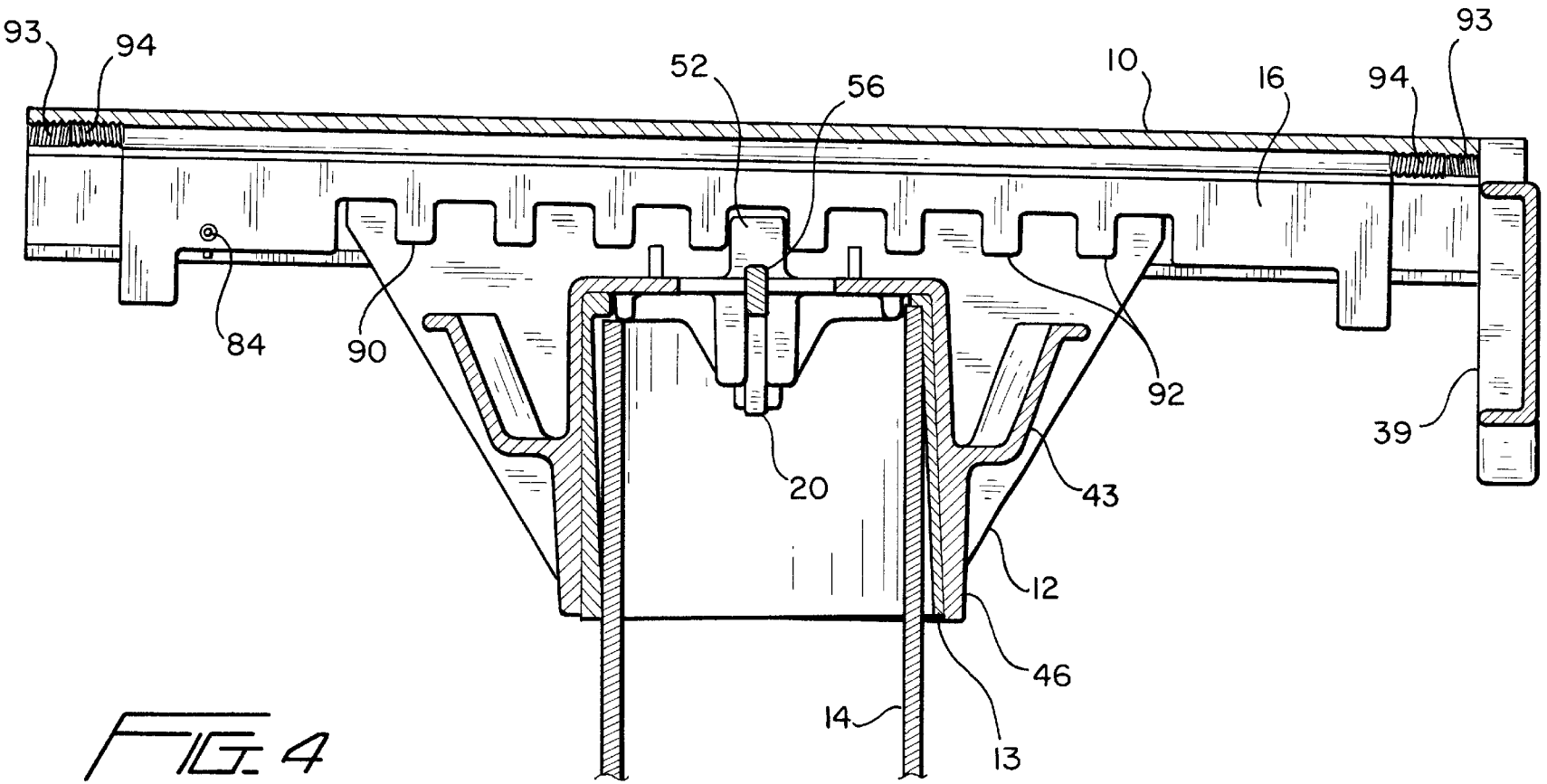
FIG. 4 is a cross section of the device showing the locking teeth of the push plate.
Figure 5:
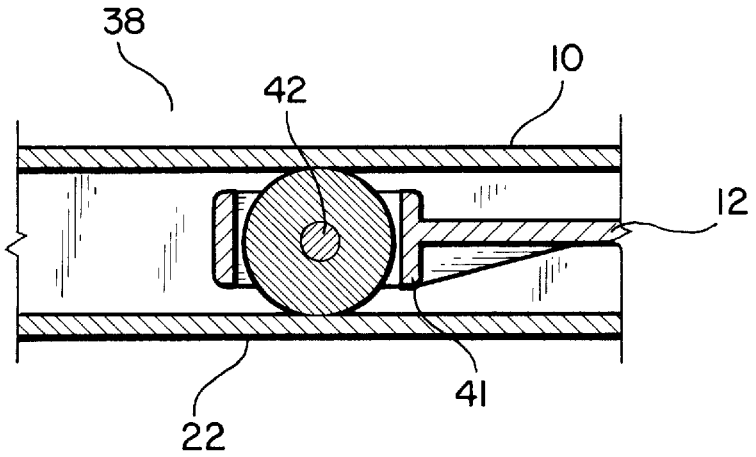
FIG. 5 is a cross section of the device showing a roller and its housing.
Figure 6:
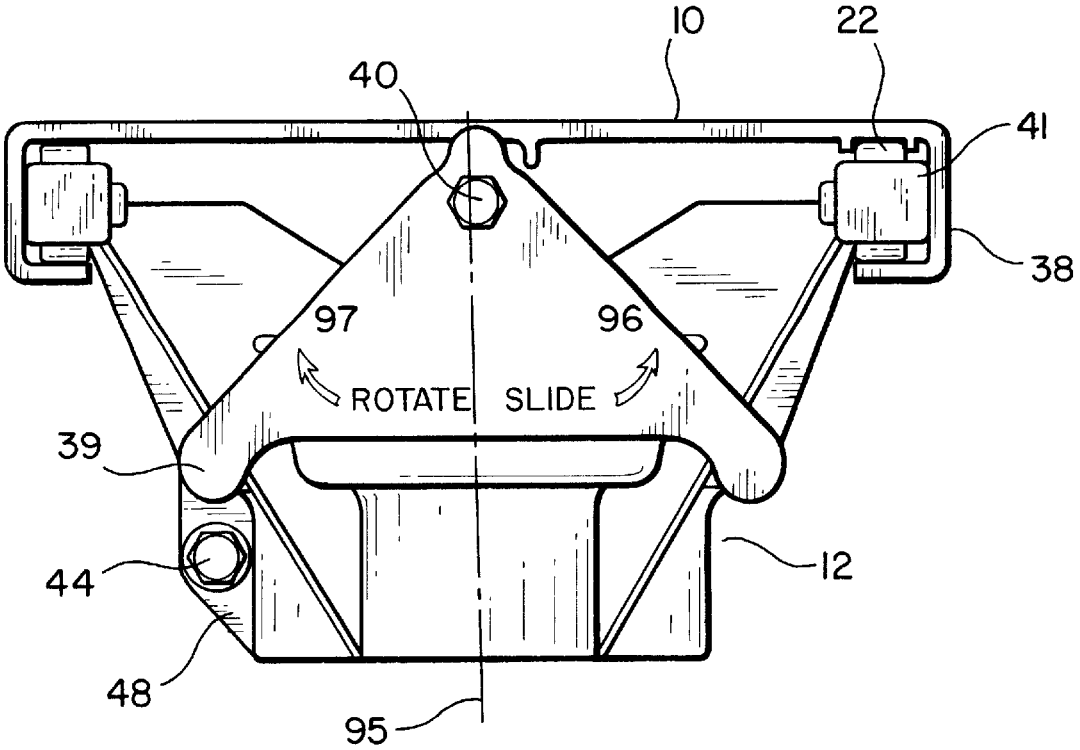
FIG. 6 is an end view of the device showing the telescoping handle.

Referring now to FIGS. 2, 3, and 5, the slide plate holder 12 is slidably attached to the bottom surface 26 of the slide plate 10 via the rollers 22. As shown in FIG. 5, the slide plate holder 12 forms a roller housing 41 that encircles each of the rollers 22. The roller housing 41 holds an axle 42 for each roller 22, so that the rollers can rotate around the axles. As best shown in FIG. 2, the rollers 22 roll within the roller channels 38, and they are in contact with the upper interior surface 38A of the roller channels 38, permitting the slide plate 10 to move longitudinally with respect to the slide plate holder 12 in non-slip relation to the rollers. The slide plate holder 12 has a web portion 43, first and second semi-cylindrical protrusions 44, 45, and a sleeve portion 46. As best shown in FIG. 3, the sleeve portion 46 of the slide plate holder 12 has a vertical slot 47, a pair of clamping ribs 48, a clamping bolt 49, and a handle 50. The handle 50 operates to tighten the sleeve portion of the slide plate holder 12 around the stationary post 14, without the use of hand tools. In accordance with another embodiment of the invention, the clamping ribs 48 may be fastened with a conventional fastener such as a nut and bolt. A locking tooth 52 for the slide locking mechanism protrudes from the second semi-cylindrical protrusion 45, and thrust plate support holes 54, 56 are formed by the semi-cylindrical protrusions 44, 45, see FIGS. 2 and 4. The thrust plate 20, has a first shaft portion 58 and a second shaft portion 59 protruding from each end, is movably supported by the thrust plate support holes 54, 56. In addition, the thrust plate 20 has a cam plate contact portion 60 and a locking tongue portion 62, and a thrust spring 63 is located around the second shaft portion 59.

As best shown in FIGS. 2 and 3, the cam plate 18 is an elongated plate that has a cylindrical head 64 located at its upper portion, a cam portion 66 with a hollow core 68 therethrough, located at its lower portion, and an intermediate neck section 69 that connects the upper and lower portions. The cylindrical head 64 of the cam plate is confined by the first reception slot 28, and it has a width or diameter that precludes release from the first reception slot 28 in a vertical direction while allowing for longitudinal insertion and rotational movement. The cam plate 18 can thus, through its cylindrical head 64, slide in opposite longitudinally directions, and rotate clockwise and counter-clockwise in the first reception slot 28.

As shown on FIG. 2, the left hand surface of the cam plate 18 has a thrust plate contact protrusion 70, and the right hand surface has a push plate contact portion 72. A tension spring 74 is connected between the push plate 16 and the slide plate 10. The tension spring 74 includes a central coil section 76 and two straight wire sections 78, 80 that terminate as hook connections. The hook connector for wire section 78 is received within a hook reception slot 82 in slide plate 10. The opposite hook connector is received within a pin hole 84 formed in the second end of push plate 16.

As also shown in FIG. 2, the hollow core 68 of the cam plate 18 preferably extends along the entire length of cam plate 18 so as to open out at opposite ends thereof, making it operative at any longitudinal position thereof. At the first end 36 of the cam plate 18, the hollow core 68 is preferably provided with threads that threadably receive the fastener 40, that extends through the base of the handle 39 to secure the telescoping handle 39 to the cam plate 18. Since the cam plate 18 may be moved longitudinally within the first reception slot 28 this permits the handle 39 to be extended from the device 2 or retracted inwardly toward the device 2 in a telescoping manner, as shown respectively in FIGS. 1 and 10.

The push plate 16, as best illustrated in FIGS. 2, 3, and 4, is an elongated, narrow width plate, that has a cylindrical head portion 88 located at its upper end and a rack portion 90 constituted of several rectangular teeth 92 located at its lower end. The semi-cylindrical head portion 88 is mounted such that the push plate 16 can rotate both clockwise and counterclockwise in the second reception slot 29 formed within the slide plate 10. The width or diameter of head portion 88 is such that it is vertically confined within the reception slot 29.

When the slide plate 10 is in a fixed state as shown in FIGS. 2, 3, 4, 7, and 8, the rack portion 90 is meshed with a locking tooth 52 provided on the top surface of the semi-cylindrical protrusion 45 of the slide plate holder 12. The slide plate 10 is in a longitudinally locked state due to the push plate 16 being in mesh with the locking tooth 52 on the sliding holder 12 so that slide plate 10 cannot move longitudinally forward or backward. Also, in order to prevent the push plate 16 itself from moving longitudinally within the reception slot 29, threaded slot sections 93 are provided on both ends of the reception slot 29 and set screws 94 are threaded into contact position with the opposite ends of the push plate 16. These components are best illustrated in FIG. 3.

The assembly of the sliding and rotating device 2 will now be described. FIG. 3 shows the undersurface of slide plate 10 after assembly. As shown in FIG. 2, reception slots 28 and 29 extend the full length of slide plate 10 and are respectively sized to receive the cylindrical head portions 64, 80 of the push plate 16 and cam plate 18. To assemble the device, the cylindrical head portion 64 of the cam plate 18 is inserted longitudinally into its respective reception slot 28, so as to have the first end 36 aligned with the first end of the slide plate 10. Next, the slide plate holder 12 and the push plate 16 are aligned for simultaneous installation into the slide plate 10. While the slide plate holder 12 is installed by aligning its rollers with the roller channels 38 of the slide plate, the cylindrical head portion of the push plate 16 is inserted longitudinally into an open end of the reception slot 29. At opposite ends of the reception slot 29 threaded sections 93 are provided. Set screws 94 are threaded inwardly until contact is made and the push plate 16 is centered and rotatably fixed therebetween, and the handle 39 is fastened to the first end of the cam plate 18.

The operation of the sliding and rotating device 2 will now be described. Referring to FIG. 6, the operator positions the handle 39 of the sliding rotating device 2 to adjust the position of the item 4 relative to a stationary supporting post 6. When the handle 39 is centered in a neutral position 95 as shown in FIG. 6, the device 2 is fully locked. When the handle 39 is rotated in a first direction 96, preferably counterclockwise, a longitudinal or sliding adjustment is possible, and when the handle 39 is rotated in a second direction 97, preferably clockwise, a rotational adjustment is possible.

Figure 10:
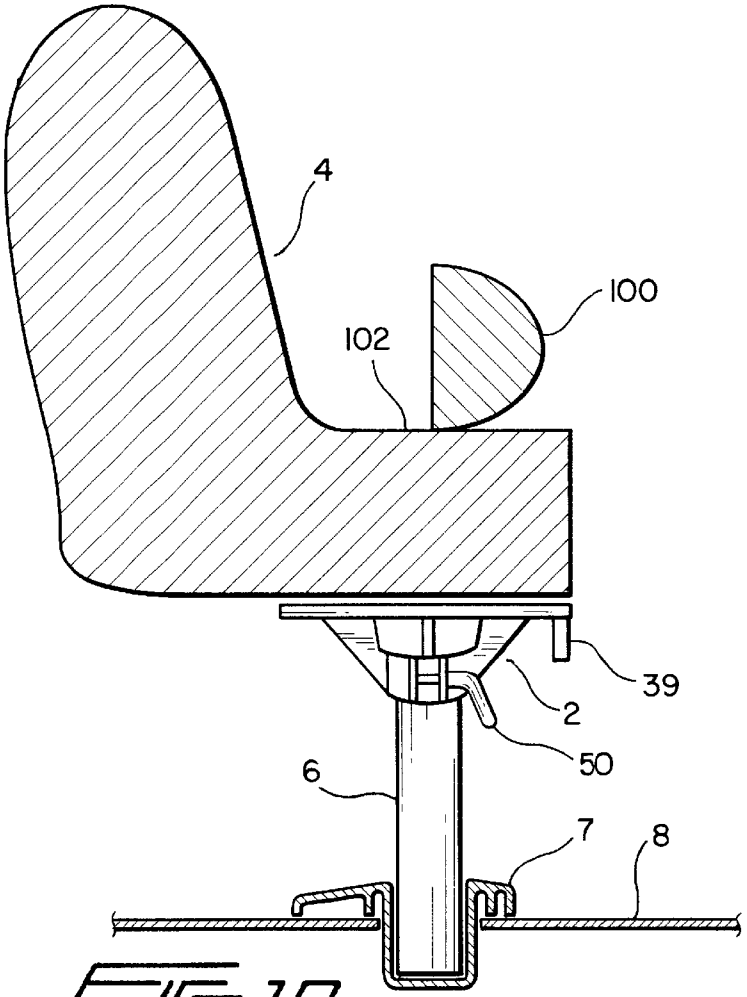
FIG. 10 is a side view of a sliding and swiveling device attached to a post-mounted chair in accordance with the invention, with the chair shown in schematic, side cross section, showing the telescoping handle fully retracted and with a thigh rest in an up position.

Referring again to FIG. 1, and also to FIG. 10, complimentary positions of the chair 4 and handle 39 are illustrated in accordance with the preferred embodiment of the invention. As noted above, the chair 4 is fastened to the slide plate 10 of the device 2, and has a rear seat portion 102, and a movable front portion 100. The movable front portion extends longitudinally beyond the forward end of the slide plate to serve as a thigh rest when the chair is occupied, and may be moved, with the use of unillustrated hinges, upward and rearward to conserve deck space, such as boat deck space, when the chair is not in use. As shown in FIG. 10, the telescoping handle 39 retracts toward the holder 12 with inward longitudinal movement of the cam plate 18, to conserve space when the device 2 is not in use, and as shown in FIG. 1, the handle 39 extends outwardly away from the holder 12 with outward longitudinal movement of the cam plate 18, so that the operator can reach and control the handle 39 with ease. In the illustrated embodiment of the invention the device supports a chair 4, however, the invention is also applicable to other type of items that extend longitudinally beyond the slide plate 10 and that may be reduced in longitudinal size.

Figure 7:
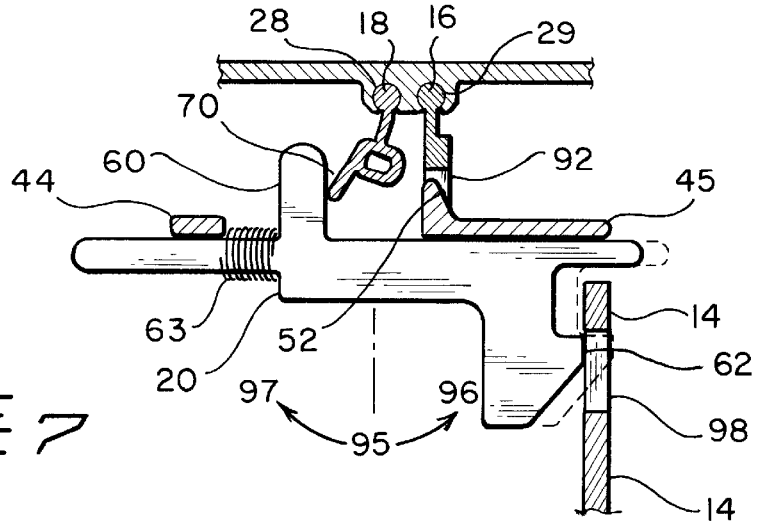
FIG. 7 is a simplified cross section of the device showing the operation of the cam plate and the push plate, when the device is unlocked to permit rotational movement.
Figure 8:
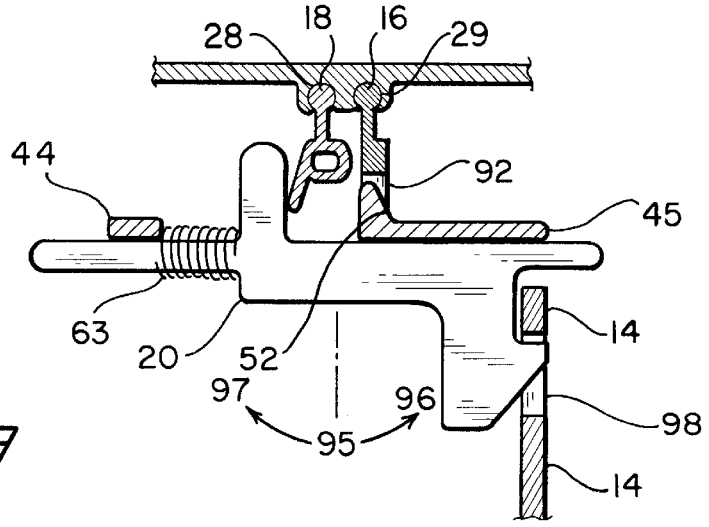
FIG. 8 is a simplified cross section of the device showing the operation of the cam plate and the push plate, when the device is in a fully locked position.

The push plate 16 and the cam plate 18 are normally biased to the neutral position 95, as shown in FIGS. 6 and 8. The tension spring 76 biases the push plate 16 toward the neutral position 95. The cam plate 18 is biased toward the neutral position 95 in the first direction 96 by the push plate 16, and the thrust spring 63 presses the thrust plate 20 toward the cam plate 18, biasing the cam plate 18 toward the neutral position 95 in the second direction 97. The push plate 16 can move in the first direction 96 only, however the cam plate 18 may move in either the first direction 96 or the second direction 97, as shown in FIGS. 7–9.

Figure 9:
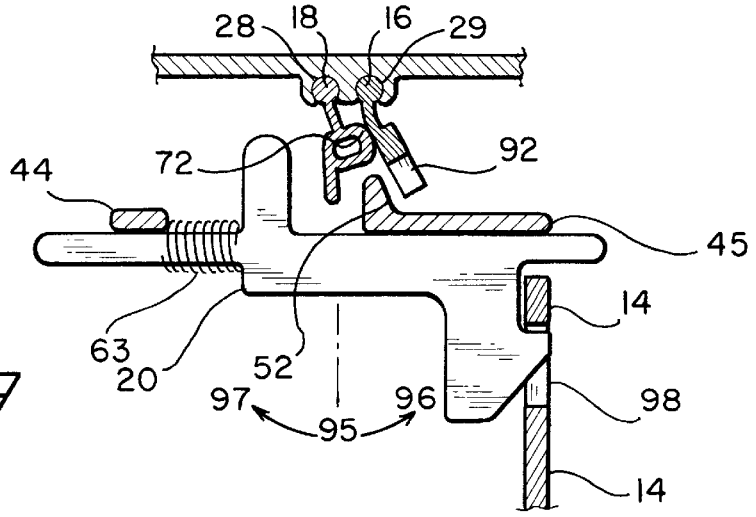
FIG. 9 is a simplified cross section of the device showing the operation of the cam plate and the push plate, when the device is unlocked to permit longituinal movement.

As best shown in FIGS. 7, 8, and 9, to facilitate an understanding of how the invention operates, an explanation is first provided as to the operation of the push plate 16 and cam plate 18. FIG. 9 illustrates the rotation of the cam plate 18 by the handle 39 in the first direction 96, preferably 45 degrees counterclockwise, for unlocking the longitudinally locked slide plate 10 from its locked neutral state 95, which is shown in FIGS. 6 and 8. The counterclockwise rotation of cam plate 18 causes the push plate contact portion 72 of the cam plate 18 to force the teeth 92 of the push plate 16 out of engagement with the locking tooth 52. The thrust plate 20 remains stationary during rotation of the cam plate 18 in the first direction 96. Also, rotation of both the cam plate 18 and the push plate 16 causes the tension spring 74 shown in FIG. 3 to be stretched, permitting the cam plate 18 to rotate in the first direction 96 out of its neutral state 95. Once the teeth 92 of the push plate 16 are rotated out of alignment with the locking tooth 52 and as soon as sufficient longitudinal force is applied to move the slide plate 10, the slide plate 10 and the chair 4 are shifted longitudinally with respect to the slide plate holder 12 and the stationary post 14, on the rollers 22. Once the handle 39 is released following the longitudinal shift in position of the slide plate 10, a new set of meshing teeth 92 on the push plate 16 meshes with the locking tooth 52 that has remained stationary while the slide plate 10 and push plate 16 were shifted longitudinally. This remeshing is caused by the spring 74 forcing the push plate 16 to return to its neutral state 95.

FIG. 7 illustrates the movement of cam plate 18 out of its vertical neutral state 95 upon rotation of the handle 39 in the second direction 97, preferably 45 degrees clockwise. Rotation of the handle 39 in the second direction 97 also rotates the cam plate 18 out from its neutral position 95. The coil portion 76 of the tension spring 74 is preferably spaced far enough away so as not to contact the cam plate 18 during such rotation.

Movement of the cam plate 18 in the second rotational direction 97 causes the thrust plate contact protrusion 70 of the cam plate 18 to abut against the cam plate contact projection 60 of thrust plate 20, so as to shift the locking tongue 62 sufficiently to cause the locking tongue 62 to move inwardly out of engagement with a vertical locking slot 98 in stationary post 14. Once the end of the locking tongue 62 clears the interior surface of stationary post 14, slide plate holder 12 with attached and longitudinally locked slide plate 10, can be rotated by a desired amount. The slide plate 10 can then be rotated in either direction until the handle 39 is released such that the locking tongue 62 again becomes aligned with another the locking slot 98 in the stationary post 14, and the compressed thrust spring 63 causes the locking tongue 62 to move back into the locking slot 98 in the stationary post 14. The stationary post 14 may also be formed with a plurality of equally spaced locking slots 98 to allow for specific stepped rotation adjustments in the longitudinally fixed slide plate 10.

Persons skilled in the art will understand from the above that various modifications and similar arrangements can be obtained within the spirit and scope of the invention, and the scope of the appended claims should be accorded the broadest interpretation so as to encompass all such modifications and similar structures.

What is claimed is:

1. A chair system, comprising:

a chair having a horizontal seat, said seat having a rear portion and a front portion longitudinally forward of said rear portion and that is pivotable upward when not in use;

a slide plate, having a support portion supporting said chair on an upper surface thereof;

a holder, adapted to be mounted on a stationary post so as to swivel thereon, said holder slidably supporting said slide plate for longitudinal sliding movement of said slide plate with respect to said holder;

a first lock releasably locking said holder against swiveling with respect to the post;

a second lock releasably locking said slide plate against longitudinal sliding with respect to said holder; and lock controlling means, including an elongated control member, for controlling said first and second locks, wherein rotating said control member in a first direction from a neutral position locks said holder against swiveling with respect to the post and rotating said control member from the neutral position in a second direction opposite said first direction locks said slide plate against longitudinal sliding with respect to said holder, said control member being extendible and retractable, said control member extending longitudinally and having a handle at one end thereof, said handle being positioned beneath said front portion of said seat when said control member is extended, and being positioned beneath said rear portion of said seat when said control member is retracted.

2. A system as claimed in claim 1, wherein said control member is operable to control said first lock and said second lock both when said control member is extended and when said control member is retracted.

3. A system as claimed in claim 1, wherein said control member is longitudinally uniform in vertical cross section so as to be operable to control the locks, when said control member is extended, when said control member is retracted and in all positions therebetween.

4. A system as claimed in claim 1, wherein said control member is longitudinally uniform in vertical cross section so that rotation of said control member in opposite directions about a longitudinal axis thereof is effective to control the locks both when said control member is extended, when said control member is retracted, and in all positions therebetween.

5. A chair system, comprising:

a chair having a horizontal seat, said seat having a rear portion and a front portion that is pivotable upward;

a slide plate, having a support portion supporting said chair on an upper surface thereof, a lower surface of the support portion having a longitudinally extending roller channel formed thereon;

a holder, adapted to be mounted on a stationary post so as to swivel thereon, said holder having a plurality of rollers longitudinally spaced apart in said channel, so that said slide plate is longitudinally slideable with respect to said holder, on said rollers;

a first lock releasably locking said holder against swiveling with respect to the post;

a second lock releasably locking said slide plate against longitudinal sliding with respect to said holder; and lock controlling means, including an elongated control member, for controlling said first and second locks, wherein rotating said control member in a first direction from a neutral position locks said holder against swiveling with respect to the post and rotating said control member from the neutral position in a second direction opposite said first direction locks said slide plate against longitudinal sliding with respect to said holder, said control member being extendible and retractable, said control member extending longitudinally and having a handle at one end thereof, said handle being positioned beneath said front portion of said seat when said control member is extended, and being positioned beneath said rear portion of said seat when said control member is retracted.

6. A system as claimed in claim 5, wherein said control member is operable to control said first lock and said second lock both when said control member is extended and when said control member is retracted.

7. A system as claimed in claim 6, wherein said roller channels are C-shaped.

8. A system as claimed in claim 7, wherein said control member is longitudinally uniform in vertical cross section so as to be operable to control the locks, when said control member is extended, when said control member is retracted and in all positions therebetween.

9. A system as claimed in claim 7, wherein said control member is longitudinally uniform in vertical cross section so that rotation of said control member in opposite directions about a longitudinal axis thereof is effective to control the locks both when said control member is extended, when said control member is retracted, and in all positions therebetween.

10. A system as claimed in claim 5, wherein said roller channels are C-shaped.

11. A system as claimed in claim 10, wherein said control member is longitudinally uniform in vertical cross section so as to be operable to control the locks, when said control member is extended, when said control member is retracted and in all positions therebetween.

12. A system as claimed in claim 10, wherein said control member is longitudinally uniform in vertical cross section so that rotation of said control member in opposite directions about a longitudinal axis thereof is effective to control the locks both when said control member is extended, when said control member is retracted, and in all positions therebetween.

13. A system as claimed in claim 5, wherein said control member is longitudinally uniform in vertical cross section so as to be operable to control the locks, when said control member is extended, when said control member is retracted and in all positions therebetween.

14. A system as claimed in claim 5, wherein said control member is longitudinally uniform in vertical cross section so that rotation of said control member in opposite directions about a longitudinal axis thereof is effective to control the locks both when said control member is extended, when said control member is retracted, and in all positions therebetween.

* * * * *